United States Patent [19]

Crowley

[11] 4,169,044

[45] Sep. 25, 1979

[54] RE-REFINING USED LUBE OIL

[75] Inventor: Ralph P. Crowley, Woods Cross, Utah

[73] Assignee: Phillips Petroleum Company, Bartlesville, Okla.

[21] Appl. No.: 946,900

[22] Filed: Sep. 28, 1978

Related U.S. Application Data

[63] Continuation-in-part of Ser. No. 817,882, Jul. 21, 1977, abandoned.

[51] Int. Cl.[2] ..... C10M 11/00

[52] U.S. Cl. ..... 208/180

[58] Field of Search ..... 208/180, 181

[56] References Cited

U.S. PATENT DOCUMENTS

| | | | |
|---|---|---|---|
| 1,766,768 | 6/1930 | Werkenthin | 208/180 |
| 3,773,658 | 11/1973 | Vu et al. | 208/180 |

*Primary Examiner*—O. R. Vertiz
*Assistant Examiner*—Wayne A. Langel

[57] ABSTRACT

Process for re-refining used lubrication oil by contacting the used lube oil in a first extraction zone with a light hydrocarbon solvent, for example, propane, yielding a first extract and raffinate. The solvent is removed from the first extract to recover desired lubrication stock base. The first raffinate is then solvent-extracted, using the same solvent to produce a second extract and raffinate. The solvent is then removed from this second extract to yield an oil which can be further refined for separation of valuable constituents or burned as fuel oil. The second raffinate is flashed to remove any remaining solvent and leave an easily discardable solid residue.

9 Claims, 1 Drawing Figure

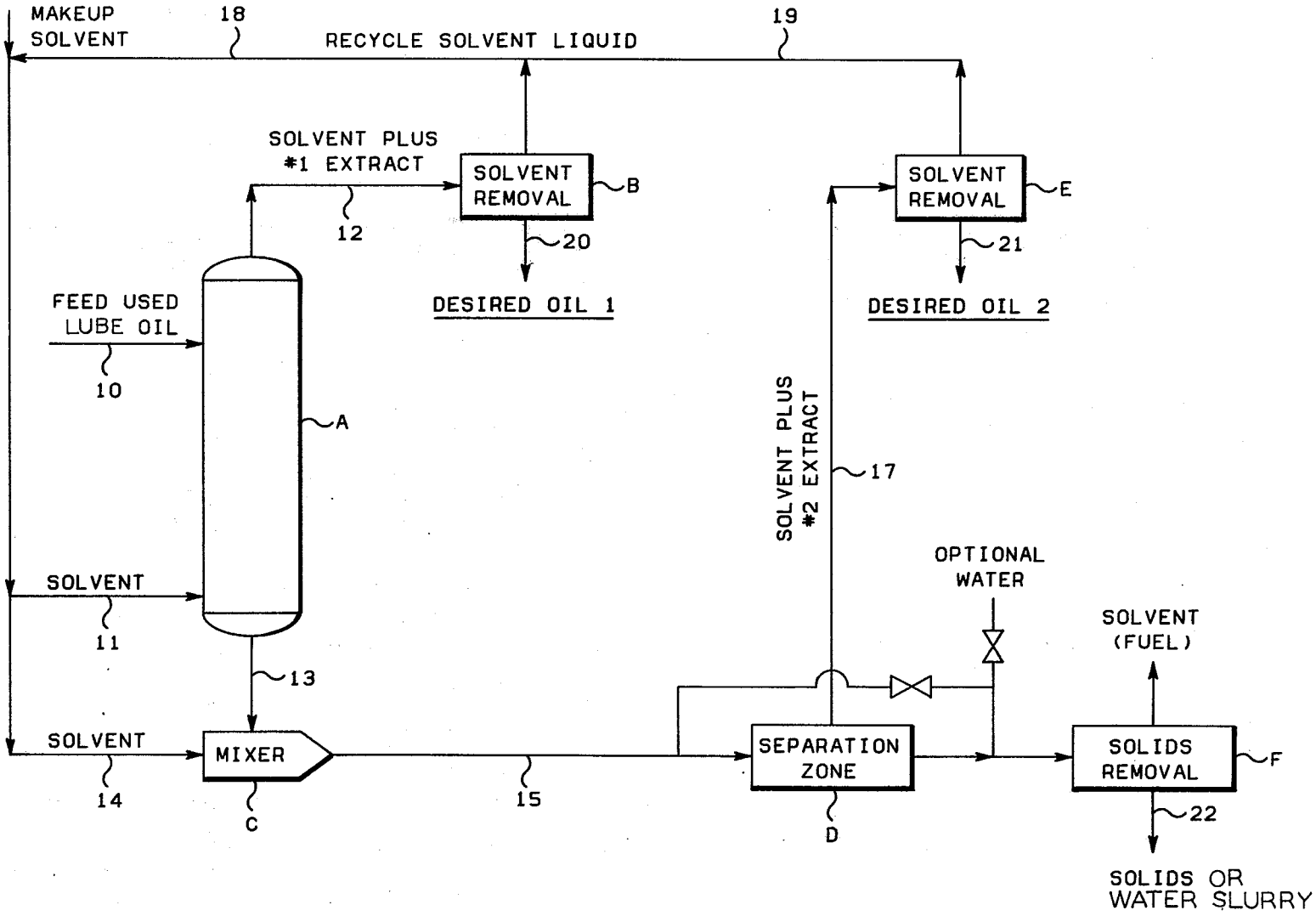
MAKEUP SOLVENT
18
RECYCLE SOLVENT LIQUID
19
FEED USED LUBE OIL
10
SOLVENT
11
SOLVENT PLUS #1 EXTRACT
12
A
13
SOLVENT
14
MIXER
C
15
SOLVENT REMOVAL
B
20
DESIRED OIL 1
SOLVENT REMOVAL
E
21
DESIRED OIL 2
SOLVENT PLUS #2 EXTRACT
17
OPTIONAL WATER
SEPARATION ZONE
D
SOLVENT (FUEL)
SOLIDS REMOVAL
F
22
SOLIDS OR WATER SLURRY

RE-REFINING USED LUBE OIL

This application is a continuation-in-part of copending application Ser. No. 817,882, filed July 21, 1977 abandoned.

SUMMARY OF THE INVENTION

This invention relates to re-refining used lubrication oil. In another aspect, it relates to re-refining used lubrication oil using a two-step solvent extraction. Another aspect of this invention is the use of a light hydrocarbon solvent in a relatively low solvent-to-oil ratio in the first solvent extraction step and in a relatively high solvent-to-oil ratio in the second solvent extraction step. Yet another aspect of this invention is the use of a higher temperature in the first solvent extraction zone with respect to the temperature in the second.

The re-refining of used lubricating oils is rendered very difficult due to the presence of lube oil additives. Not only are the lube oil additives difficult to remove, but they interfere with the removal of other impurities. Previous re-refining processes have had difficulties as to equipment maintenance, the quantity and quality of oil removed, and the disposal of heavy viscous bottoms fractions. One present method of re-refining used lubricating oil is to propane solvent-extract the used oil to obtain a propane-oil solution and a bottoms fraction containing the insoluble impurities. Disposal of this heavy, viscous bottoms fraction is troublesome.

The present invention provides a process for re-refining used lubricating oil that can yield a good quality base lubricating oil, recover substantially all the oily fraction of the used lubricating oil using a first extraction step, and provide a viable solution to the troublesome problem of disposal of the heavy, viscous bottoms fraction using a second extraction step. The instant invention, after subjecting the used lubricating oil to an extraction step with a light hydrocarbon solvent, subjects the raffinate (bottoms fraction) to an additional solvent extraction step at a high solvent-to-oil ratio. This second extraction step will remove the remaining oily fraction and leave an insoluble residue containing impurities such as carbon, lead, phosphorus, calcium, and metal additives frequently used in lubricating oils. This residue will be in the form of discrete, solid particles which can be separated from any remaining solvent by conventional solid-liquid separation techniques. The oil from the second extraction step can be further refined for separation of valuable constituents or burned as fuel oil without the need for electrostatic precipitation and/or scrubbing.

An object of the present invention is to provide a process for re-refining used lubrication oil.

Another object is to re-refine used lubricating oil using a multistep solvent extraction process.

Another object is to eliminate the problems of disposal of the heavy, viscous bottoms fraction in a re-refining process for used lubrication oil.

Yet another object is to extract from used lubricating oil any valuable constituent therein.

Other objects, aspects, and the several advantages of this invention will be apparent to one skilled in the art upon a study of the disclosure, the drawing, and the appended claims.

BRIEF DESCRIPTION OF THE DRAWING

The FIGURE shows an illustrative embodiment of the instant invention wherein used lube oil is re-refined using a two-step solvent extraction.

DETAILED DESCRIPTION OF THE INVENTION

In the re-refining of used lubricating oils, the used lube oil charge can be considered as comprising four general types of material: (1) paraffinic or waxy materials readily soluble in such solvents as propane, butane, and isopentane; (2) resins—ring-type compounds and/or oxygenated materials of intermediate solubility; (3) asphaltenes—heavy condensed ring compounds insoluble in the light hydrocarbon solvents; and (4) contaminants such as water, carbon, coke, metals, inorganic particulate matter, etc., also insoluble in the solvent employed. Lube oil additives, which fall in the fourth class of components, cause many difficulties in the refining of used lube oil that do not exist in the refining of other types of oil. The metal lube oil additives are not only difficult to remove, but they also cause difficulties in the removal of other impurities. The disposal of the heavy metal contaminants causes a problem as well, due to the heavy, viscous bottoms fraction formed after a solvent extraction.

The present invention overcomes the problems caused by the lube oil additives by extracting with a large volume of a light hydrocarbon solvent, preferably aliphatic hydrocarbons of 3 to 6 carbon atoms per molecule including propane, butane, isobutane, pentane, isopentane, hexane, isohexane, and mixtures thereof, in a solvent-to-oil liquid volume ratio of about 6:1 to about 10:1, and then mixing the bottoms fraction (raffinate) from the primary extraction step with an even larger volume of light hydrocarbon solvent, on the order of at least 10:1 and preferably a 15:1 to 50:1 solvent-to-oil liquid volume ratio, in a second extraction step. The use of the large volume of solvent eliminates many of the problems, the metal lube oil additives cause in the refining of used lubricating oil.

The use of two extraction steps, as well, solves some of the problems involved in the refining of used lube oil containing metal additives. The second extraction step, besides allowing one to recover substantially all of the oily fraction of used lube oil, eliminates the problem of the heavy, viscous bottoms fraction. Subjecting the heavy, viscous bottoms to a second extraction yields an insoluble residue in the form of discrete, solid particles which are easily disposed.

In order to assure a good extraction of usable oil from the used lube oil charge, conditions in the extraction zones are accordingly maximized. In general, solvent power decreases as temperature approaches critical for the solvent employed. To improve separation, therefore, the extraction tower in the first extraction step of the present invention is normally operated with a temperature difference of about 10° to 20° F. between the top of the tower and the bottom. The temperature at the top of the tower is generally maintained between about 170° and about 200° F., whereas the temperature in the bottom of the tower is maintained between about 160° and about 185° F. The pressure maintained in the first extraction tower is kept between 580 to 620 psig, at a solvent-to-oil liquid volume ratio of about 6:1 to about 10:1. At the colder bottom temperature, some of the constituents of intermediate solubility, i.e., the resins, are dissolved along with the more soluble materials, i.e., the paraffinic or waxy materials. As the dissolved material passes toward the higher temperature zone at the top of the tower, the less soluble materials tend to be forced from solution. This provides an internal reflux akin to that employed in a distillation column and gives sharper separation.

The first extraction zone is thereby separated into fractions: one a solvent-rich extracted oil top fraction, and the other a solvent-lean heavy, viscous bottoms fraction or raffinate. The solvent-rich extracted oil fraction is passed to a solvent removal zone to remove the solvent and recover the good lubrication oil. The temperature of the solvent removal zone is in the range of about 250° to 350° F. and a pressure of about 150 to 200 psig. The raffinate is then subjected to a second extraction step to obtain maximum extraction of any soluble material remaining in the raffinate. The extraction, therefore, is carried out at a high solvent-to-oil liquid volume ratio of at least 10:1 and preferably 15:1 to 50:1, and at a temperature lower than that employed in the first stage extraction. The higher solvent-to-oil ratio and lower temperature allow for the maximum extraction of any soluble material remaining in the raffinate and thereby leave an insoluble residue in the form of discrete, solid particles which is easily disposed.

The higher solvent-to-oil ratio in the second extraction zone is such as to be at least 1½ times the solvent-to-oil ratio in the first extraction zone. To illustrate, if the solvent-to-oil ratio in the first extraction was about 10:1, then the solvent-to-oil ratio in the second extraction should be at least 15:1.

The treatment in the second extraction zone is also effected at temperatures at least 5° F. below the lowest or bottoms temperature in the first extraction zone. The temperature of the second extraction zone can be generally in the range of about 85°–175° F. with a pressure of about 300 to 550 psig. Sufficient pressures are maintained in both zones to insure liquid phase operation.

The raffinate subjected to the second extraction step is thereby separated into a top fraction of solvent-rich extracted oil and a bottoms fraction, or raffinate, of an insoluble material. The extracted oil is then passed to a solvent removal zone, operated at a temperature in the range of about 250°–350° F. and a pressure in the range of about 150 to 200 psig, to remove the solvent from the extracted oil which would find use as a fuel oil, a cutter stock for road oils, or as catalytic cracker charge, without need for further purification. The insoluble material in the raffinate is a solid dispersed as discrete, non-adherent particles susceptible to conventional solids-liquid separation techniques such as flashing, filtration, centrifuging, gravity settling, etc. Disposal of the relatively small volume of oil-free bottoms product is not a significant problem. If desired, water can be added after the second solvent extraction step C thereby forming a separate water phase containing the insoluble impurities which can be carried from the system in a water-solids slurry via 22. As a further alternative, the second raffinate can be flashed to remove any solvent and thereby leave a solids residue which can be carried from the system for disposal in a water slurry.

In the illustrative embodiment depicted in the FIGURE and table, used lubricating oil is fed into the top or side of extraction zone A, maintained at a pressure of 600 psig and a temperature at the top of the tower at 185° F. and at the bottom of the tower at 175° F., by line 10. The used lube oil is comprised of such components as metal additives, carbon, coke, inorganic particulate matter, water, light hydrocarbons, heavy (asphaltene) type hydrocarbons, and resins. The solvent is fed into the extraction zone A by line 11 near the bottom of the tower so that it flows countercurrent to the used lube oil so that good oil is taken off the top by the solvent to solvent removal zone B, maintained at a temperature of 320° F. and a pressure of 190 psig, by line 12. The solvent used can be propane, butanes, or pentanes, or any mixture thereof. For purposes of the illustrative embodiment, a 70 percent volume-30 percent volume propane-normal butane mixture is used. The liquid volume ratio of solvent to used lube oil is about 8:1. The solvent removed is recycled by line 18, and the good, extracted oil is removed by line 20 for storage or further use.

The raffinate or bottoms of zone A is removed by line 13 into a second extraction zone C which is maintained at a temperature of 170° F. and a pressure of 400 psig. Propane-normal butane liquid solvent enters the extraction zone by line 14 in a 25:1 solvent-to-oil liquid volume ratio. The effluent from the extraction zone is then charged to separation zone D, maintained at a temperature of 165° F. and a pressure of 390 psig, by way of line 15. In zone D, extracted oil and solvent is taken off the top by line 17 to a solvent removal zone E which is maintained at a temperature of 320° F. and a pressure of 190 psig. The solvent removed is recycled via line 19, and the extracted oil is removed via line 21 to storage or further use.

The raffinate or bottoms of zone D is passed to a solids removal zone F, maintained at a temperature of 150° F. and a pressure of 5 psig, where any remaining solvent is flashed from the solids with solids being removed by line 22. Optionally, the raffinate can be placed in a water slurry, flashed in zone F, and then removed by line 22 in a water slurry.

The illustrative conditions, i.e., temperature, pressure, solvent ratios, and flow rates in barrels/hour, applicable to the foregoing illustrative embodiment are summarized in the table.

| | Operating Conditions | |
|---|---|---|
| | Specific | General Ranges |
| First Extraction Zone (A): | | |
| Top Temperature, °F. | 185 | 170 to 200 |
| Bottom Temperature, °F. | 175 | 160 to 185 |
| Pressure, psig | 600 | 580 to 620 |
| Solvent-to-Oil Ratio | 8/1 | 6/1 to 10/1 |
| Solvent Removal Zone (B): | | |
| Temperature, °F. | 320 | 250 to 350 |
| Pressure, psig | 190 | 150 to 200 |
| Second Extraction Zone (C): | | |
| Temperature, °F. | 170 | 85 to 175 |
| Pressure, psig | 400 | 300 to 550 |
| Solvent-to-Oil Ratio | 25/1 | 10/1 to 50/1 |
| Separation Zone (D): | | |
| Temperature, °F. | 165 | 150 to 180 |
| Pressure, psig | 390 | 290 to 540 |
| Solvent Removal Zone (E): | | |
| Temperature, °F. | 320 | 250 to 350 |
| Pressure, psig | 190 | 150 to 200 |
| Solids Recovery Zone (F): | | |
| Temperature, °F. | 150 | 80 to 200 |
| Pressure, psig | 5 | 5 to 10 |
| Solvent Composition: | | |
| Propane, Vol. Percent | 70 | 0 to 100 |
| Normal Butane, Vol. Percent | 30 | 100 to 0 |
| (10) Used Lube Oil, barrels/hour | 208 | |
| 8 contains metal additives, carbon, coke, inorganic particulate | | |

-continued

| | | Operating Conditions | |
|---|---|---|---|
| | | Specific | General Ranges |
| | matter,water, light hydrocarbons, heavy (asphaltene) type hydrocarbons, resins, etc.] | | |
| (11) | Liquid Solvent, barrels/hour (About 50—50 Propane-n-Butane) | 1,664 | |
| (13) | Bottoms Residue, barrels/hour | 40 | |
| (14) | Liquid Solvent, barrels/hour | 1,000 | |
| (20) | Cleaned Lube Oil, barrels/hour | 168 | |
| (21) | Heavy Oils, barrels/hour | 36 | |
| (22) | Solids, barrels/hour | 4 | |

Certain modifications of the invention will become apparent to those skilled in the art, and the illustrative details enclosed are not to be construed as imposing unnecessary limitations of the invention.

I clam:

1. A process for re-refining used lubricating oil comprising the steps of:

subjecting the used lubricating oil to a solvent extraction in a first extraction zone with a light hydrocarbon solvent under such conditions of temperature and pressure to separate a solvent-rich extract oil fraction from a solvent-lean bottoms fraction;

recovering substantially purified lube oil from said solvent-rich extract oil fraction;

subjecting said solvent-lean bottoms fraction to a solvent extraction in a second extraction zone with said light hydrocarbon solvent at a higher solvent-to-oil liquid volume ratio of at least one and one-half times that solvent-to-oil ratio employed in the first solvent extraction and under such conditions of temperature and pressure, including a lower temperature than employed in the first solvent extraction, to thereby separate a second solvent-rich extract oil fraction from a second solvent-lean bottoms fraction;

recovering substantially purified heavy oil from said second solvent-rich extract oil fraction; and removing substantially all the remaining solvent from the solids in said second solvent-lean bottoms fraction.

2. A process as in claim 1 wherein:

said second solvent-lean bottoms fraction is flashed to remove substantially all the remaining solvent snad thereby recover a solids residue which can be discarded.

3. A process as in claim 2 wherein:

water is added to said solvent-lean bottoms fraction to form a water phase and thereby remove the solids residue from the flashing zone in a water slurry.

4. A process as in claim 1 wherein the temperature near the top of said first extraction zone is 10° to 20° F. higher than that near the bottom of said zone.

5. A process as in claim 4 wherein:

the temperature in said first extraction zone is in the range of about 170° to 200° F. near the top and 160° to 185° F. near the bottom with the pressure in said first extraction zone in the range of about 580 to 620 psig; and the temperature in said second extraction zone is in the range of about 85° to 175° F. and the pressure in the range of about 300 to 550 psig.

6. A process as in claim 1 wherein said light hydrocarbon solvent is selected from the group consisting of propane, butanes, and pentanes, and any mixture thereof.

7. A process as in claim 6 wherein said saturated hydrocarbon solvent is a 70 percent volume propane: 30 percent volume n-butane mixture.

8. A process as in claim 1 wherein the solvent-to-oil liquid volume ratio in said first extraction zone is in the range of about 6:1 to 10:1 and the solvent-to-oil liquid volume ratio in said second extraction zone is in the range of about 10:1 to 50:1.

9. A process as in claim 1 wherein the lower temperature employed in the second extraction zone is at least 5° F. lower than the lowest temperature in the first extraction zone.

* * * * *